United States Patent [19]

Narita

[11] 4,337,109

[45] Jun. 29, 1982

[54] PROCESS OF PREPARING AN ORNAMENT FOR TOMBSTONES OR THE LIKE

[76] Inventor: Kinjo Narita, No. 292, Ooaza Wattokumachi Hirosaki-shi, Aomori-ken, Japan

[21] Appl. No.: 199,313

[22] Filed: Oct. 21, 1980

Related U.S. Application Data

[62] Division of Ser. No. 46,506, Jun. 7, 1979, Pat. No. 4,259,381.

[30] Foreign Application Priority Data

Jun. 8, 1978 [JP] Japan ..... 53-69215

[51] Int. Cl.[3] ..... E04H 13/00

[52] U.S. Cl. ..... 156/293; 52/104; 428/13; 428/67

[58] Field of Search ..... 428/13, 67; 40/124.5; 52/104, 172; 156/293

[56] References Cited

U.S. PATENT DOCUMENTS

| | | | |
|---|---|---|---|
| 1,737,474 | 11/1929 | Newhouse | 40/124.5 |
| 1,946,033 | 2/1934 | Potter | 40/124.5 |
| 2,068,830 | 1/1937 | Warembourg | 40/124.5 |
| 2,684,266 | 7/1954 | Englehart | 52/232 X |
| 2,704,211 | 3/1955 | Decepoli | 428/13 X |
| 3,438,159 | 4/1969 | Bergener et al. | 40/124.5 X |
| 4,014,122 | 3/1977 | Woods | 428/13 X |

*Primary Examiner*—Henry F. Epstein

*Attorney, Agent, or Firm*—Birch, Stewart, Kolasch & Birch

[57] ABSTRACT

An ornamental element adapted to be fixed to a monument which comprises a transparent body having a frontside portion and a backside portion, said frontside portion having a convex lense shape; a recess provided in the backside portion of said transparent body for receiving a desired document; and a sealing means disposed within said recess adjacent to the document for protecting the document within the ornamental element from the environment.

3 Claims, 3 Drawing Figures

FIG. 3
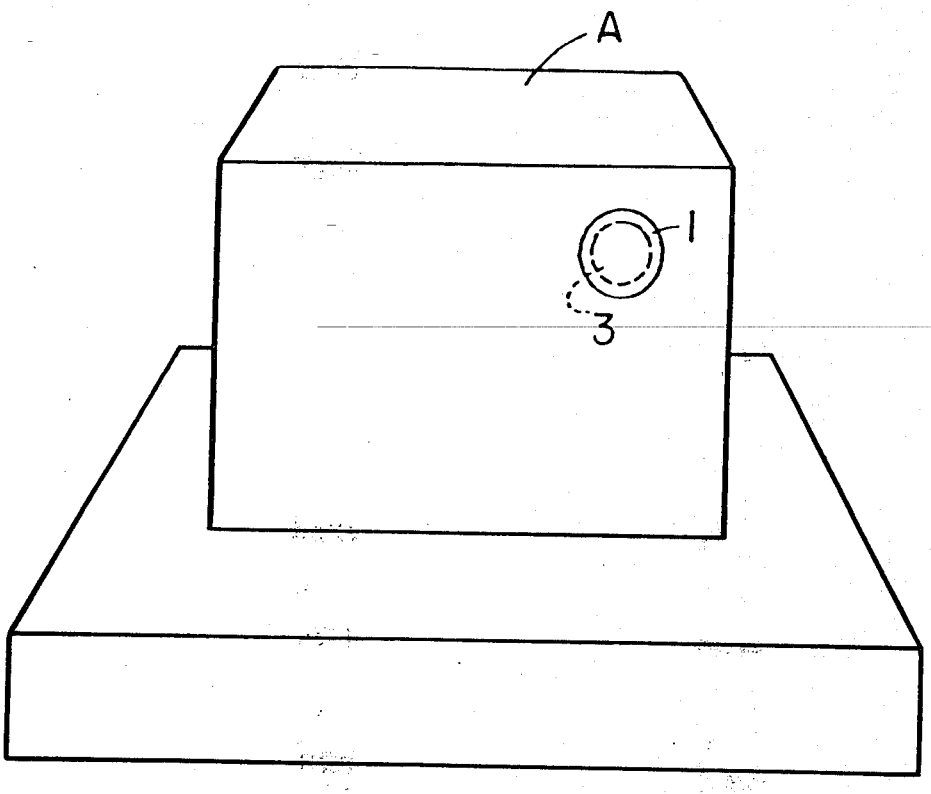
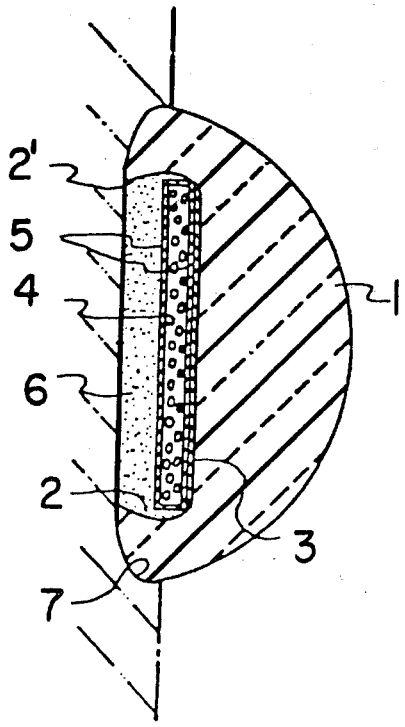
FIG. 2
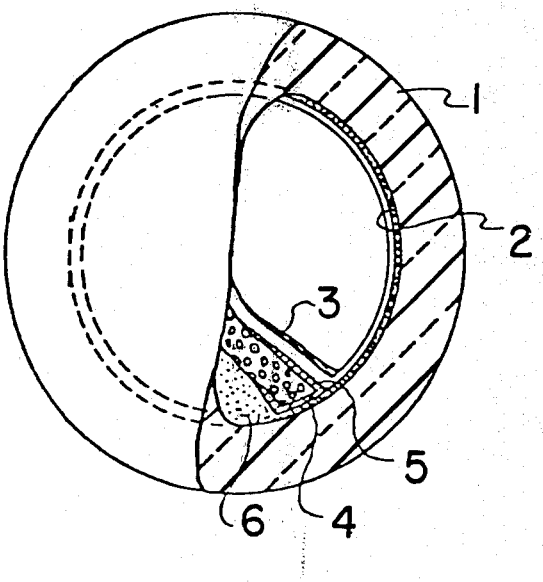
FIG. 1

PROCESS OF PREPARING AN ORNAMENT FOR TOMBSTONES OR THE LIKE

This is a divisional of copending application Ser. No. 046,506, filed June 7, 1979, now U.S. Pat. No. 4,259,381.

BACKGROUND AND SUMMARY OF THE INVENTION

The present invention relates to an ornament which can be fixed to a tombstone or burial movement. More particularly, the present invention is directed to an ornament containing a personalized document, such as for example, a photograph or similar type of reminder so that people visiting the tombstone are caused to think of the dead or the person identified by the tombstone.

According to the present invention, there is provided an ornament which is solidly fixed to a tombstone or to a burial monument or any other type of monument which comprises a transparent body having a convex lense shape, a recess provided in the back portion of the body, a desired photograph or other type of identifying material set into the recess, a desicant covered with waterproof paper and plaster positioned over the photograph in the recess.

If the above-described ornament is fixed to a tombstone or to any other type of monument, people visiting a grave, in the case where the monument is a tombstone, will be caused to recall or think about the dead person more readily and in a more vivid manner. For example, people visiting their family tombs will be able to think of their ancestors in a visible manner. Since the transparent body which makes up the ornament is shaped into a convex lense form, even a small photograph is magnified when viewed. Accordingly, since the ornament does not have to be made in a large dimension, the appearance of the monument is not adversely affected by applying the ornament to the monument.

Accordingly, an object of the present invention is to provide a means for identifying a particular monument which is relatively small in size but at the same time provides the viewer with a clear vision of the contents thereof.

Another object of the present invention is to provide an ornament-type means which can be permanently attached to a monument and which is adapted to contain a descriptive-type of document in a sealed, environmentally protected state.

A further object of the present invention is to provide an ornament which can be permanently fixed to a tombstone, said ornament being adapted to contain a personalized document, for example, a photograph, which is intended to remind the people visiting the tombstone of the deceased person which is identified by the tombstone.

Other objects and further scope of applicability of the present invention will become apparent from the detailed description given hereinafter; it should be understood, however, that the detailed description and accompanying specific examples, while indicating preferred embodiments of the invention, are given by way of illustration only, since various changes and modifications within the spirit and scope of the invention will become apparent to those skilled in the art from this detailed description. These changes and modifications are intended to be encompassed within the scope of this invention.

BRIEF DESCRIPTION OF THE DRAWINGS

The present invention will become more fully understood from the detailed description given hereinbelow and the accompanying drawings which are given by way of illustration only, and thus are not limitative of the present invention, and wherein, FIG. 1 is a plan view, partially in section, of the ornament of the present invention;

FIG. 2 is a side sectional view of the ornament of the present invention; and FIG. 3 is a perspective view of a monument containing the ornament of the present invention fixed thereto.

DETAILED DESCRIPTION OF THE INVENTION

The ornament which is fixed to a monument according to the present invention comprises a body 1 made of a transparent material, such as glass or a synthetic resin, formed into a semi-circular or convex lense shape. A photograph or other type of identifying material 3 is set into a recess 2 provided in the body 1. The convex nature of the body 1 provides for the magnification of the photograph when it is placed in the recess 2. The recess 2 is disposed at the backside of the body 1 in such a manner that the diameter of its marginal surface 2' is smaller than that of its inside portion. That is, the recess 2 has a reverse C cross-sectional shape, that is, a ↄ cross-sectional shape. The recess 2 is adapted to contain a photograph 3 or the like by which one can be caused to think about the content of the photograph when viewing the monument.

The photograph or other document is fixed to the bottom of the recess by a desiccant 4 covered by moisture-proof paper 5 and a sealer material 6 made of, for example, plaster. The desiccant, paper and plaster are applied to the recess in this order. The desicant 4 with the moisture-proof paper 5 is overlapped on the back of the photograph. The desiccant is preferably a powder-type material which serves to prevent the photograph 3 from becoming dampened or mildewed. The plaster 6 solidly holds the photograph 3 and the desiccant 4 in place and protects them from water. The plaster is introduced into the recess 2 so that the back surface of the body 1 is provided with an even finish.

The thus produced ornament can then be fixed to a monument by a suitable adhesive or bonding agent as can be seen in FIG. 3. If the monument or tombstone A is provided with a recess 7 which is adapted to receive the ornament 1, then the ornament can be strongly and semi-permanently fixed to the stone in a water-protective manner. While FIG. 3 shows how the ornament of the present invention can be fixed to a monument, FIGS. 1 and 2 show the interrelationship between the various constituents which make up the ornament of the present invention.

If the ornament of the present invention is fixed to a tombstone or the like, people visiting a grave will remember or recall the dead more readily and more vividly. Thus, people visiting their family tombs will be able to more easily think of their ancestors in a visible manner. Since the transparent body is shaped in a convex lense form, even a small photograph is magnified when viewed. Accordingly, since the ornament need not be made of a large size, the appearance of the monument is not adversely affected by the application of the ornament to the monument.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A process of preparing an ornamental element adapted to be fixed to a monument which comprises:

providing a transparent body having a convex lense shape in the front side portion thereof, said body having a recess provided in the back side portion for receiving a desired document, said recess having a margin projecting inwardly such that the diameter of the marginal surface is smaller than the diameter of the inside portion of said recess;

introducing a powder-type desiccant material into said recess so as to cover the document;

applying a water-proof paper over said desiccant; and introducing a sealer material into the remaining portion of the recess adjacent to said waterproof paper overlying the desiccant for sealing and protecting the document from the environment.

2. The process as disclosed in claim 1 wherein said sealer material comprises plaster which provides an even finish to the back surface of the ornamental element.

3. The process as disclosed in claim 1 wherein said document is a photograph.

* * * * *